United States Patent [19]

Unger

[11] Patent Number: 4,459,921

[45] Date of Patent: Jul. 17, 1984

[54] METHOD AND APPARATUS FOR BURNING INERTS, PARTICULARLY FLOTATION ADDLES MIDDLINGS, CLARIFICATION PONDS AND/OR DOMESTIC REFUSE AS A FIRING MATERIAL IN A GRATE FIRING

[76] Inventor: Guenther Unger, Humboldt-/Heidestrasse, D-5628 Heiligenhaus, Fed. Rep. of Germany

[21] Appl. No.: 316,847

[22] Filed: Oct. 30, 1981

[30] Foreign Application Priority Data

Oct. 31, 1980 [DE] Fed. Rep. of Germany ..... 3041025

[51] Int. Cl.[3] ..... F23G 5/06

[52] U.S. Cl. ..... 110/226; 110/244; 110/227; 110/276; 432/103

[58] Field of Search ..... 110/218, 226, 227, 246, 110/264, 275, 276, 224; 431/168; 432/103

[56] References Cited

U.S. PATENT DOCUMENTS

| | | | |
|---|---|---|---|
| 1,251,146 | 12/1917 | Ward | 110/276 |
| 1,320,481 | 11/1919 | Lee | 126/181 |
| 2,015,842 | 10/1935 | Christensen | 110/227 |
| 2,104,040 | 1/1938 | Hurt | 110/226 |
| 3,358,623 | 12/1967 | Lenz et al. | 110/226 |
| 3,487,792 | 1/1970 | Dixon et al. | 110/246 |
| 3,716,339 | 2/1973 | Shigaki et al. | 110/226 |
| 3,871,285 | 3/1975 | Bastgen | 110/226 |
| 3,882,801 | 5/1975 | Bolle | 110/246 |
| 3,889,610 | 6/1975 | Williams | 110/244 |

FOREIGN PATENT DOCUMENTS

| | | | |
|---|---|---|---|
| 288642 | 2/1969 | Australia | 340/110 |
| 1483048 | 9/1969 | Fed. Rep. of Germany | 432/103 |
| 276626 | 8/1930 | Italy | 110/35 |

*Primary Examiner*—Henry C. Yuen

*Attorney, Agent, or Firm*—Hill, Van Santen, Steadman & Simpson

[57] ABSTRACT

Inerts, particularly flotation addles and/or middlings are burned as a fire material in a grate firing and form a solid slag which is mechanically comminuted during the firing process. Comminution is accomplished with grate elements which are movable with respect to the slag and which are cooled by feeding combustion air therethrough, the combustion air being directly injected from the grate elements into the firing material.

12 Claims, 11 Drawing Figures

METHOD AND APPARATUS FOR BURNING INERTS, PARTICULARLY FLOTATION ADDLES MIDDLINGS, CLARIFICATION PONDS AND/OR DOMESTIC REFUSE AS A FIRING MATERIAL IN A GRATE FIRING

BACKGROUND OF THE INVENTION

1. Field of the Invention

The present invention relates to a method and to an apparatus for burning inerts, particularly flotation addles and/or middlings, as a firing material in a grate firing upon formation of a solid slag.

2. Description of the Prior Art

As used herein, the term "inerts" in the sense of the present invention relates to all types of high-ash through very high-ash coal waste as generally arise in the production process and/or up-grading of coal or coal-containing material. In the broadest sense, what is meant by the term includes such high-ash fuels as peat, oil-saturated sands or shales and other wastes combustible material up to and including garbage whose burning has been considered unsuitable, and uneconomical, in known grate firings because of the production of large amounts of solid slag. Such inerts, therefore, were heretofore usually viewed as "waste" and deposited at waste dumps whereby, in addition to being useless and an environmental problem, considerable dumping costs arose. In some instances, it has been attempted to burn inerts mixed with low-ash coal, but the problem of solid slags arising given the burning of inerts cannot be eliminated in such a process. In some instances, also, waste coal with material containing addles has been employed for land-fill in lower stratum, for example, in gravel quarry regions. Such a measure can likewise only be viewed as being a poor temporary solution and not at all be viewed as a meaningful exploitation. A demonstration based on publications of such measures, moreover, is hardly possible.

SUMMARY OF THE INVENTION

Therefore, the object of the present invention is to make available a new method and a corresponding apparatus with whose assistance one can succeed in usefully exploiting the energy content still existing in inerts by employing the same as a firing material in a grate firing, while overcoming the difficulties heretofore prohibiting an economical and useful exploitation due to the production of large amounts of solid slag, these difficulties particularly including the fact that the burning process is suffocated by the slags building up into sinter cakes.

The above object is achieved in that the slag is mechanically comminuted in the grate firing during the operation of the firing process.

An advantage arises in practicing the invention in that the formation of a coherent, more or less gas-impermeable sinter layer of slag is prevented and, therefore, the burning process is maintained by maintaining free flow paths for the combustion air.

A further measure is provided in an advantageous manner essential to the invention that, while being heated, the combustion air is fed through the grate elements and, emerging from the grate elements with an increased temperature and velocity, is directly injected into the firing material, whereby the grate elements are cooled by means of transmitting heat to the combustion air.

These two measures, which interact, produce an overall effect of an undisputed, placid and intensive burning process with the inerts of such a nature as was previously not considered possible.

It is thereby proposed that the comminution is carried out by means of the application of mechanical forces and/or movements in the grate firing.

In particular, in accordance with an advantageous feature of the invention, it is further proposed that the comminution be carried out by means of the movement of grate elements which can be driven from outside of the firing chamber.

In comparison to known methods or devices in conjunction with grate firings, the underlying idea of the new measure derives as an advantage that it is proposed to employ the grate elements themselves in a manner which is advantageous for the comminution of the slag.

With such a technique, one can make use of one of the further features of the invention that, namely, the comminution is undertaken either continuously or discontinuously at prescribed time intervals given a respectively prescribed duration.

The selection of one of these measures can be undertaken by one skilled in the art depending on his experience and observations. This largely depends on visible attendant circumstances or parameters of the individual case and is a decision to be evaluated in purely case-related terms.

Thereby, it is further advantageously provided under certain conditions that the uncrushed inerts which are particularly gained by means of drying flotation addles are employed as the firing material.

In this context, a measure which is advantageous, particularly on the basis of economic considerations, arises in that a part of the dry inerts forming during the drying of the flotation addles is employed as the firing material for the drying process.

A device for implementing the method of the invention is characterized in that the grate elements forming the firing grate are designed as slag crushing tools and/or are equipped with slag crushing tools; and in that the grate elements are movably disposed, but with a fixed location, and are connected to at least one drive for executing movement which result in a crushing of the slag.

Therefore, because the grate elements themselves undertake the crushing function, there derives as a significant advantage that the comminution process topically occurs precisely at that location where the best effect can be achieved, namely, at the grate level. Moreover, a further comminution device which could potentially disrupt the firing in some other manner is avoided and, in addition, the fall-through the comminuted slag particles is also promoted.

It is further provided that the grate elements are tubularly designed and are connected to an air source outside of the firing chamber for the supply of combustion air and that they exhibit jet-like discharge openings for the combustion air in the area of firing.

As already indicated in conjunction with the method of the present invention, this simple measure turns the grate elements into a heat exchanger—simultaneously with their design to form crushing tools—by means of which the required combustion air arrives pre-heated into the burning zone, this being extremely useful given fuels having a low calorific value. In addition, due to the discharge of the combustion air from the jet-like openings, i.e. in a high-energy stream, a bellows effect which uncommonly stimulates the burning process arises and, moreover, directly in the innermost area of the combustion zone. At the same time, the slag is made crushable due to cooling.

A further improvement thereby derives on the basis of the proposal that the grate elements are provided with discharge openings for the combustion air which are directed up and, in particular, exhibit the shape of jets having cross and/or longitudinal slots.

In order to arrive at a very uncomplicated, but nevertheless very effective and easily manufactured design of the slag crushing tools, it is further proposed that the slag crushing tools are designed as fitted radial cams whose length is preferably designed greater than the grate spacing.

Thereby, these crushing tools can be designed in the shape of pyramids. However, it has also been conceived to design the crushing tools as rotating or at least partially rotating ribs.

In this context, the invention does not make a final determination concerning the one or other purely structural shape given the large, case-by-case multitude of greatly different designs of such slag tools which is possible and which all share the concept that they can be designed as bodies projecting out of the grate plane. Such bodies can be shaped cylindrically angularly, pyramidally, rib-like, straight, bent or hooked, if only they meet the purpose of crushing the slag given motion relative to the slag.

Thereby, it is advantageous and, just like the cooling of the grate elements, essential to the operation and for the mechanical stability required for its execution that, further, it is proposed that the slag crushing tools are designed hollow for the passage of combustion air.

And, finally, it is advantageous that the grate elements according to the present invention are connected to drive devices for generating periodic, preferably oscillating rotary and/or axial motion.

Advantageously, the device also exhibits an auxiliary burner for starting the burning process and for heating the firing-up in order to thus gasify the least inflammable inerts and bring the same to combustion temperature.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
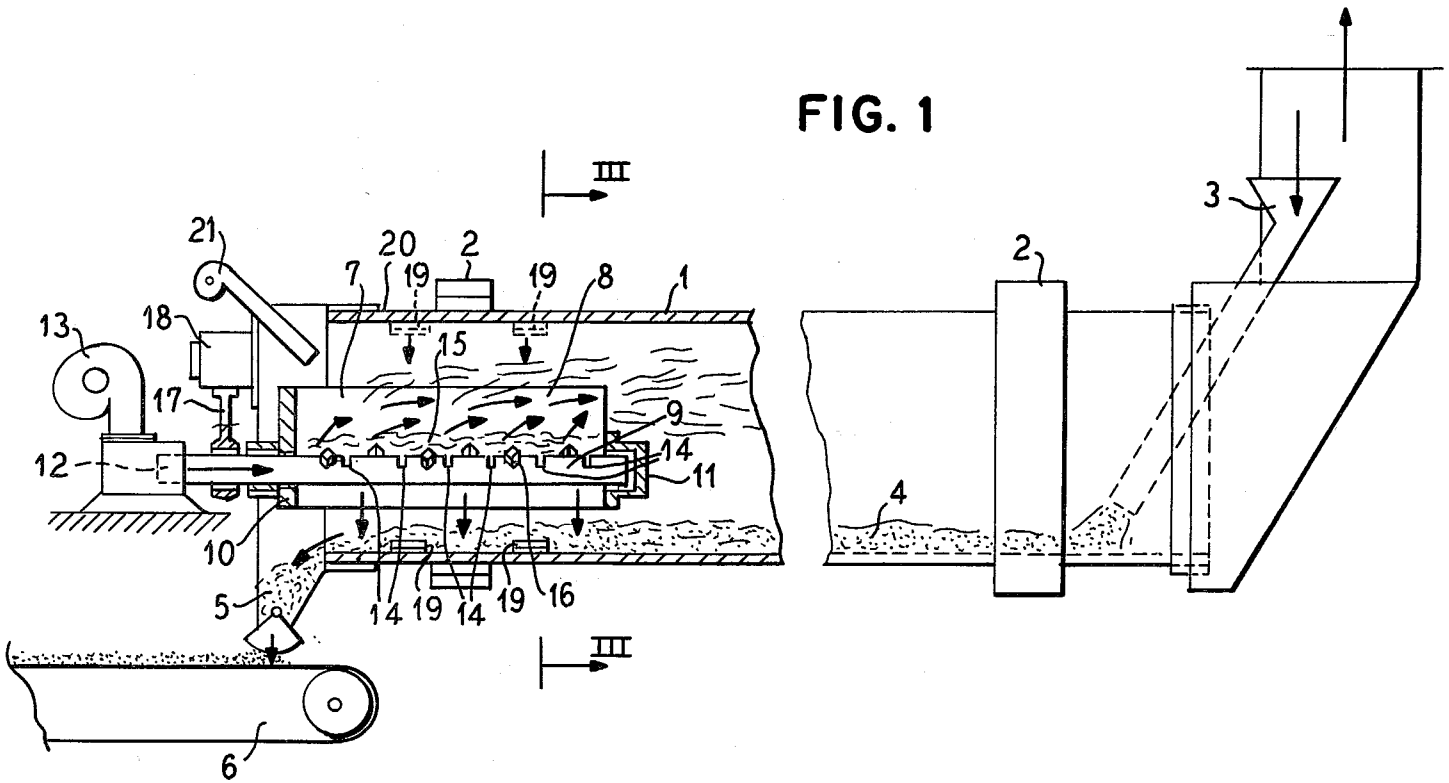
FIG. 1 is a schematic illustration of grate firing in accordance with the present invention, employed in a drying apparatus, shown partially in section.

In FIG. 1, a drying drum 1 is connected by way of bearing races 2 to roller blocks (not illustrated) which are presumed to be known in the art and drive devices, and rotates about its axis with a standard speed, for example, 5–6 rpm. The material to be dried is delivered through a chute 3 which extends through the exhaust gas side of the drying drum 1, the material being delivered in counter-flow to the drying gas. The material migrates through the drum as a material layer 4 and is delivered in its dried state through a discharge 5 onto a conveyor belt 6. The generation of the hot gas as required for the drying process occurs by means of a grate firing 7 constructed and operated in accordance with the present invention. The grate firing 7 is disposed with the drying drum 1 and comprises a firing chamber 8 which includes a certain termination toward the bottom due to a plurality of grate elements 9 but which, nonetheless, exhibits gas permeability standard in a grate. The grate elements 9 are rotatably seated and/or are seated with a limited axial mobility in a front end wall 10 and in a rear end wall 11 of the firing chamber 8. Outside of the drying drum 1, the ends 12 of the grate elements 9 are connected to a combustion air blower 13 which feeds combustion air with a delivery pressure of, for example, 500 mm WS through the grate elements 9, the grate elements 9 being designed as tubes, and injects the air through jet-like discharge slots 14 into a bed 15 of the grate firing 7. The emerging combustion air has been heated during passage through the heated grate elements 9 and therefore arrives through the discharge slots 14 directly into the bed 15 of the firing 7 with an increased temperature and, as a result of pressure relaxation, with increased speed as well.

Crushing tools 16 are carried on the grate elements 9, exhibiting the shape of obliquely-radially emplaced cubic cams. Given a rotary and, under certain conditions, also an axial movement, they are arranged tooth-/gap/tooth/gap and prevent a sinter cake of solid slag being formed in statu nascendi in that they constantly destroy the arising slag agglomerate. Thereby, the advantage is also involved, that the solid slag layer or clod in the process of formation has not yet "advanced" to its final solidity and is therefore relatively easy to crush given increased temperature and continuous, or at least frequent, disruption. Thereby, the continuous cooling of the grate elements 9 also plays an important role insofar as this greatly promotes the preservation of the stability of the grate elements, for which reason one can forego the employment of very expensive and, nota bene, highly intractable materials for the grate elements 9. For the purpose of initiating the described crushing movements, the grate elements 9 are coupled by way of an arm 17 to a drive 18 which, however, is illustrated in a highly schematic manner. Important for the operation of the firing in the illustrated exemplary embodiment are the lift scoops 19, designed as ladle elements, since these, given the presumption that the material 4 is to be dried is a matter of inerts, scoop up a little of the dry inerts and dump the same onto the grate firing 7 in order to maintain the fire. An "automatically" maintained firing therefore occurs with this simple measure, given which a certain possibility of regulation can be provided in that the position of the lift scoops 10 can be changed with a setting device which extends through the jacket 20 of the drum 1 (not illustrated). An auxiliary and ignition burner completes the illustrated device of the overall drying aggregate; it is referenced with the character 21 and is disposed in such a manner that its flame is directed directly into the grate firing 7.

Figure 2:
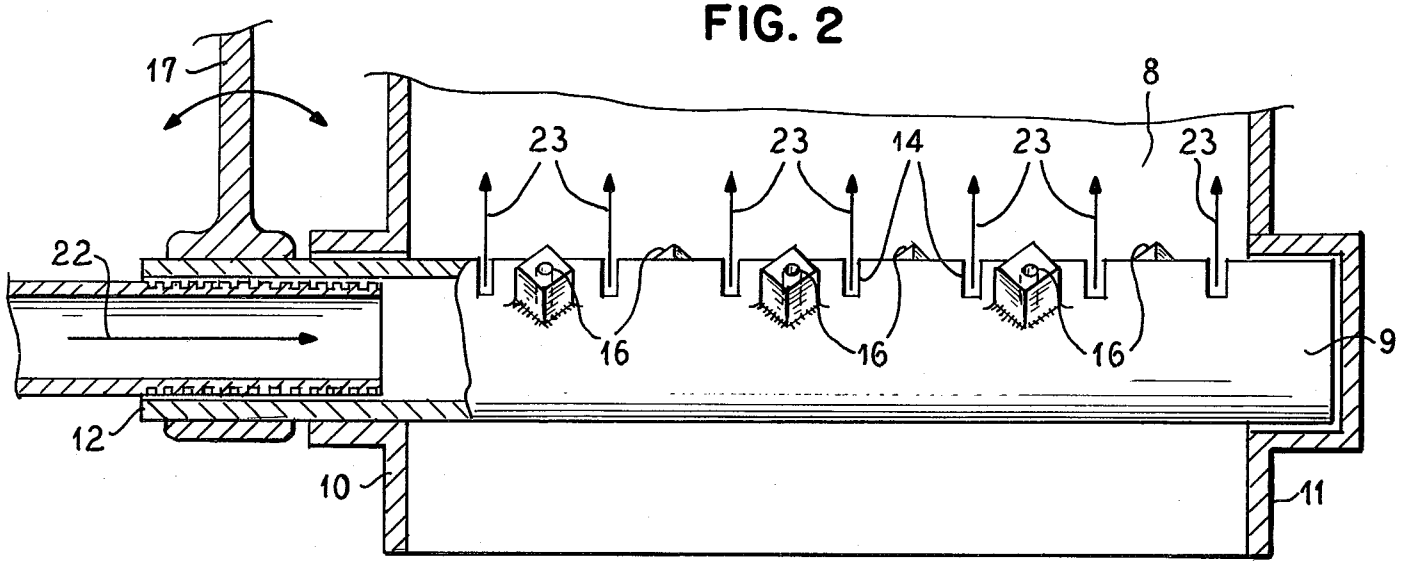
FIG. 2 is an elevation, shown partially in section, of the grate firing according to FIG. 1.

FIG. 2 illustrates the grate firing 7 in an enlarged scale. Elements identical with those of FIG. 1 have been provided with the same reference characters. The entering combustion air is referenced with an arrow 22 and the air streams emerging from the jets are referenced with the arrows 23. One can also clearly see the crushing tool 16 as well as the arm 17 which introduces the movement of the drive 18 (only shown in FIG. 1) to the grate element 9.

Figure 3:
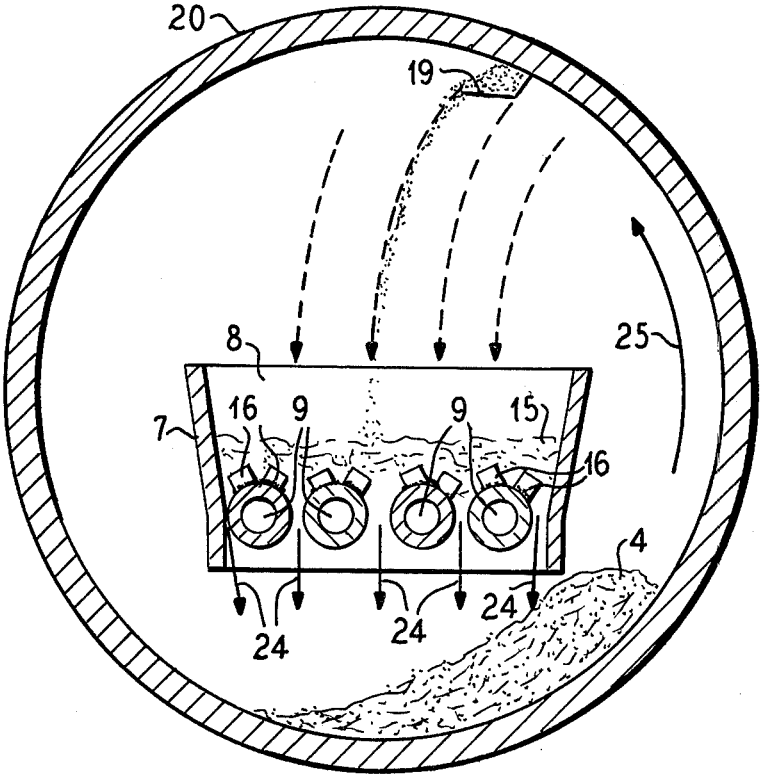
FIG. 3 is a sectional view taken along the line III—III of FIG. 1, further illustrating the grate firing in accordance with the present invention.

FIG. 3 is a cross-sectional view through the drying drum 1 and the grate firing 7. This illustration was selected because it clearly demonstrates the position of the grate elements 9 with respect to one another, the position and disposition (one of many possible variations) of the crushing tool 16, the position and disposition of the firing chamber 8, the operation of the lift scoops 19, the fall-through of the crumbled slack particles 24, the motion of the material layer 4 and the rotary motion (arrow 25) of the drying drum 1.

Figure 4A:
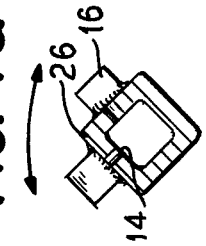
FIG. 4 illustrates a grate element having a quadratic cross-section, with an arrangement of crushing tools and air discharge jets, as shown in a side view, with FIG. 4*a* being a sectional view taken along the line IV*a*—IV*a* of FIG. 4.
Figure 4:
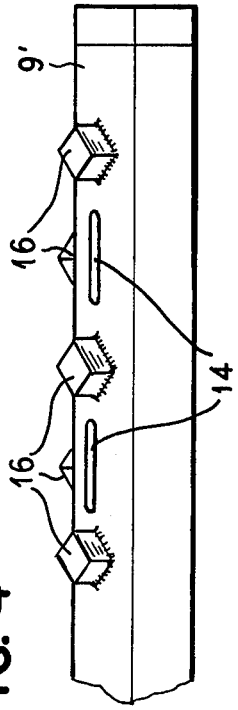
Figures 5A, 5B, 5C, 5D:
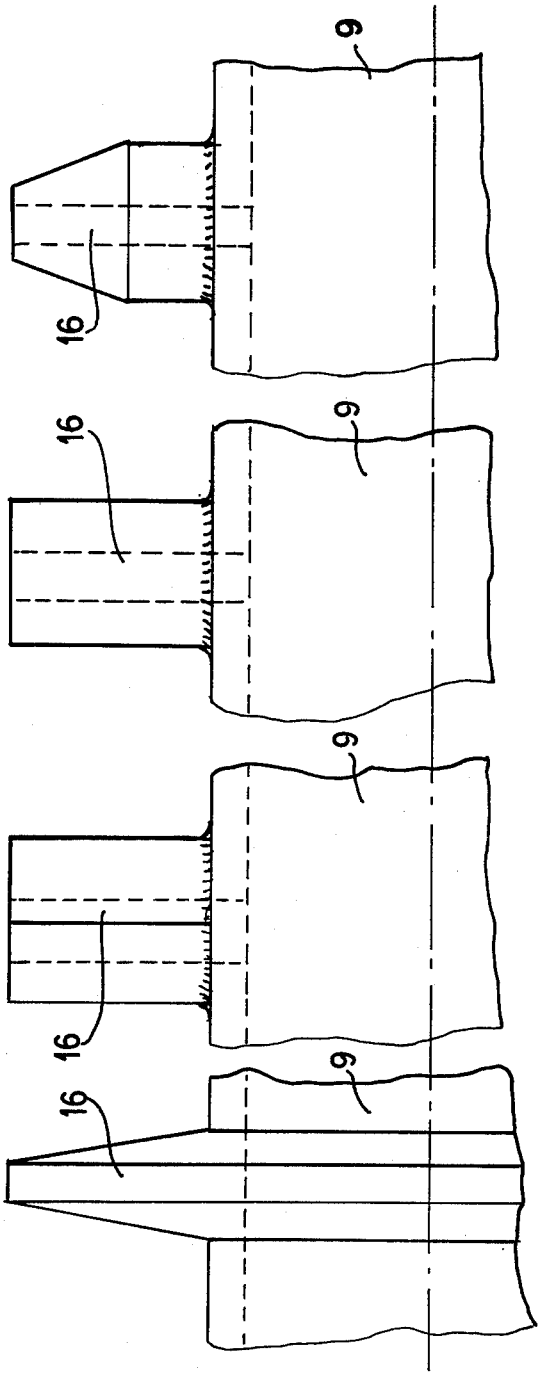
FIGS. 5*a*–5*d* illustrate various designs of crushing tools in accordance with the invention.

The grate element 9′ of FIGS. 4 and 4*a* comprises a quadratic profile and is preferably disposed in the grate firing 7 in such a manner that one of its angular, roof-like profile edges 26 points upwardly. Moreover, the crushing tool 16 and the slot-shaped air jets 14 are clearly shown.

As mentioned above, the crushing tools may be of various design. Certain exemplary embodiments of such crushing tools are illustrated in FIGS. 5*a*–5*d*. These tools, in sequence, are formed as a rib in FIG. 5*a*, as a quadrangle oriented at 45° in FIG. 5*b*, as a cylinder in FIG. 5*c*, and as a cylinder with a conical extended portion in FIG. 5*d*. In accordance with the previous statements with respect to design possibilities, it should again be pointed out that the shapes illustrated herein by way of example represent only a small selection from possible designs, whereby at least all such designs are included within the scope of the invention, as bodies projecting from the surface of the grate element, and which are in position of crushing a slag structure given motion relative thereto.

Figure 6:
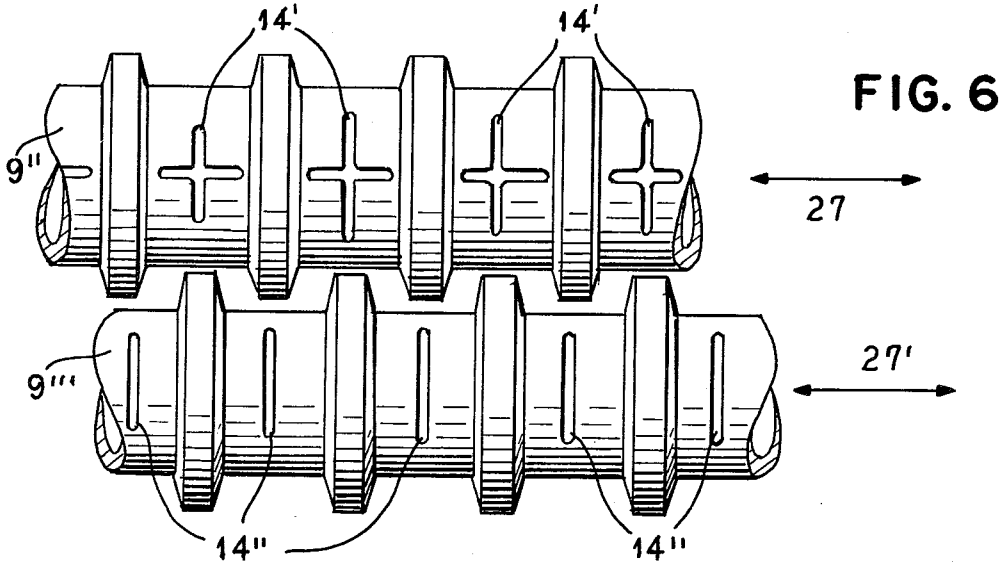

In FIG. 6, a completely different type of a design of grate elements are illustrated at 9″ and 9‴ in which ribs are employed for comminution, as briefly mentioned above, whereby this like comminution is executed by an oscillatory axial movement (arrows 27 and 27′) which, if necessary, can have a relatively short stroke. In this embodiment, the air slots 14′ are advantageously, because of good air distribution, formed as crosses, or may be formed as circumferentially extending slots as in the grate elements 9‴, i.e. the slots 14″.

Over and above the advantages mentioned in the foregoing, the burning method of the present invention further offers the advantages that the piece size of the slag can be influenced by the grate spacings; that, in contrast to eddy current combustion, the temperature is adjustable; and that the production of dust is low. Overall, there derives a method for burning inerts, for example, flotation addles, which is superior to eddy current combustion both with respect to the capital costs and with respect to controllability.

In a further, particularly advantageous development which is suitable, for example, for the good burning of clarification pond sludge or domestic refuse, it is provided that the firing comprises a fuel distribution and metering device including rotary blades or vanes, particularly having the same surface area as that of the firing. By so doing, a uniform surface feed of the grate elements is achieved which prevents a blow-out of flames toward the top and the creation of holes in the burning fuel layer.

It is provided in a further development of this embodiment of the invention that the fuel distribution and metering device is connected to the firing by a closed fire box having an upper side which is terminated by the fuel layer on the distribution and feed means. By so doing, it is advantageously achieved that the discharge of the combustion gases does not occur toward the top but can, rather, occur in the longitudinal direction of the combustion chamber. Particularly given clarifying pond sludges or when burning household refuse, there therefore derives an important, complete combustion of the gases expelled from the fuel during combustion for the purpose of eliminating odors. At the same time, the fuel on the fuel distribution and metering device is predried.

For protection against overheating of the fuel as well, it is thereby provided that the fuel distribution and metering device comprise cross-shaped, mechanically moved cell vanes or blades which engage in one another in a discharging manner when they move, this being an embodiment which is operationally reliable particularly for clarifying pond sludge or household refuse.

Figure 7:
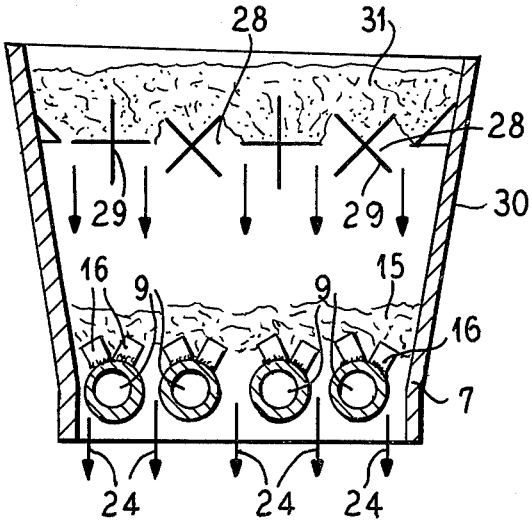
FIG. 6 is a plan view of heating grate elements having rib-like crushing tools and slot-shaped air discharge nozzles disposed longitudinally and cross wise and FIG. 7 is a sectional view of another embodiment of the invention suitable for burning clarification pond sludge or domestic refuse and is shown as including a fuel distribution and metering device having rotary vanes or blades.

The development of the firing 7 with the fuel distribution and metering device 28 is illustrated in FIG. 7. In FIG. 7, the rotary cell vanes or blades 29 and the closed fire box 30 are illustrated. In addition, the pre-drying fuel layer (31) is shown which terminates the fire box 30 toward the top. The firing elements 9, 15, 16 and 24 have already been described above.

I claim:

1. Apparatus for drying high-ash refuse coal, comprising:

a rotary firing chamber including a grate, said grate mounted, with respect to said drum, as in a fixed cantilever structure; means for rotating said firing chamber;

feeding means for feeding high-ash refuse coal onto said grate for firing;

said grate comprising movably mounted grate elements each carrying slag crushing members, each of said grate elements comprising a tube including a first passageway therethrough and each of said crushing elements comprising a second passageway in communication with said first passageway and terminating in an air jet for supporting a flow of cooling combustion air and directing the same into the high-ash refuse coal;

means for firing the high-ash refuse coal on said grate to produce heat and slag; and means for moving said grate elements relative the slag for comminuting the slag with said crushing members.

2. The apparatus of claim 1, wherein:

each of said jets is an opening through a respective crushing member.

3. The apparatus of claim 1, wherein:

each of said slag crushing members extends radially toward an adjacent grate member and is rib-shaped.

4. The apparatus of claim 1, wherein:

each of said slag crushing members extends radially toward an adjacent grate member and is cylindrical.

5. The apparatus of claim 1, wherein:

each of said slag crushing members extends radially toward an adjacent grate member and is cone-shaped.

6. The apparatus of claim 1, wherein:

each of said slag crushing members extends radially toward an adjacent grate member and is rectangularly-shaped.

7. The apparatus of claim 1, wherein:

each of said slag crushing members extends radially toward an adjacent grate member and is cylindrical comprising a cone-shaped distal end.

8. The apparatus of claim 1, wherein:

said air jets open through said crushing members.

9. The apparatus of claim 1, wherein:

said air jets open through said grate elements between crushing members.

10. Apparatus for drying high-ash refuse coal, comprising:

a rotatable drying chamber for receiving a flow of high-ash refuse coal therethrough, comprising a rotatable hollow drum and means for rotating said rotatable hollow drum;

first feed means for feeding high-ash refuse coal into said drying chamber;

discharge means for discharging the dried coal from said drying chamber;

a firing chamber including a grate comprising movably mounted grate elements;

each of said grate elements comprising a hollow tube including a passageway for supporting a flow of cooling combustion air, and a plurality of crushing elements carried on said tube, each of said crushing elements including an air jet opening in communication with said passageway;

second feed means for feeding a portion of the high-ash refuse coal being dried onto said grate from above said grate for burning to produce heat and slag, said second feed means comprising scoop elements fixed to the interior of said drum to scoop inert material from below and dump the same from above onto said grate; and drive means connected to said grate elements for moving the same relative the slag to comminute the slag with said crushing elements.

11. The apparatus of claim 10, and further comprising;

means communicating with said hollow grate elements for supplying a flow of cooling combustion air therethrough.

12. The apparatus of claim 10, and further comprising:

an auxiliary ignition device for directing a flame directly onto the high-ash refuse coal carried on said grate.

* * * * *